United States Patent [19]

Koll

[11] 4,073,016

[45] Feb. 14, 1978

[54] TRANSFER MECHANISM

[75] Inventor: Laurel A. Koll, Ruleville, Miss.

[73] Assignee: Mobilizer Medical Products, Inc., Summit, N.J.

[21] Appl. No.: 697,155

[22] Filed: June 17, 1976

[51] Int. Cl.[2] ..... A47B 83/04

[52] U.S. Cl. ..... 5/81 R; 5/86

[58] Field of Search ..... 5/60, 81 R, 81 B, 86

[56] References Cited

U.S. PATENT DOCUMENTS

| | | | |
|---|---|---|---|
| 3,760,435 | 9/1973 | Jardine | 5/81 C |
| 3,765,037 | 10/1973 | Dunkin | 5/81 C |
| 3,871,036 | 3/1975 | Attenburrow | 5/81 R |
| 3,947,902 | 4/1975 | Conde et al. | 5/81 R |

*Primary Examiner*—Casmir A. Nunberg

*Attorney, Agent, or Firm*—Lane, Aitken, Dunner & Ziems

[57] ABSTRACT

A transfer mechanism especially suited for use in the handling and transfer of non-ambulatory hospital patients and having at least one thin plate-like support movable from a retracted position relative to a deck outwardly over a bed or other surface to or from which the patient is to be transferred and loaded by extension of the support under the patient. The support plate is extensible beyond its own width and also through a distance larger than the width of a deck structure on which it may be superimposed by virtue of a carriage assembly with which the separator is translated. Friction between the patient and the laterally translated support is avoided by a thin flexible apron covering the support and movable relative to it in a manner such that the surface presented to the patient is either stationary or movable with the separator. An unique drive arrangement is provided by which translation of the support, carriage relative to the deck and of the apron relative to the separator may be effected by a single reversible drive motor for supplying torque to an endless translating drive chain which may be coupled or decoupled from a second apron driving endless chain depending on the drive parameters called for by the particular mode of mechanism operation. In addition to the aforementioned apron, a lower apron formed by a double ended belt may extend around a lower separator as well as the extensible portion of the carriage assembly so that movement of the second or lower separator and the carriage relative to the bed or other surface may be isolated. The translating drive chain organization also operates a winding roller to pay in or out one end of the lower apron.

41 Claims, 19 Drawing Figures

99
100
102
104
106
108
110
90
120
118
122
88
144
86
142
141
36
18
92
94
96
95
84
82
78
164
136
154
56
70
172
128
132
80
76
74
72
28
140
130
138
42

100'
104'
108
106
110
90'
120
122'
118
56
186
136
154
18
36
94
182
144'
184
142'
138
128
180
74'
72
28
172'
42'

TRANSFER MECHANISM

BACKGROUND OF THE INVENTION

This invention relates to improvements in apparatus for transferring objects and more particularly, it concerns an improved transfer mechanism for use principally in the transfer of non-ambulatory patients from a hospital bed or other surface on which they are initially reclined to the mechanism by which they may be supported and/or subsequently transferred to a second surface such as a surgical table, X-ray table or another bed.

The development of patient transferring apparatus of the type to which the present invention pertains is reflected in the disclosures of the following U.S. Pats.: No. 3,493,979 issued Feb. 10, 1970 to Laurel A. Koll and Walter Crook, Jr.; No. 3,579,672 issued May 25, 1971 to Laurel A. Koll and Walter Crook, Jr.; and No. 3,765,037 issued Oct. 16, 1973 to Albert Dunkin. The apparatus disclosed particularly in the latter two of these patents has been commercialized and is currently used in many hospitals and similar institutions.

Such apparatus generally includes a vertically adjustable and wheeled base supporting a transfer mechanism having a fixed deck carrying a pair of laterally translatable superposed, sheet-like apron supporting separator members about which a pair of upper and lower fabric-like aprons are trained. The aprons are established by very thin endless belts formed of teflon coated nylon fabric and are independently controlled in a manner such that during lateral extension of the separators out over a bed and under a patient to be transferred, the respective flight portions of the upper and lower aprons which contact the patient and the bed remain relatively stationary and thus isolate both the patient and the bed from frictional contact with the laterally moving separator plates. When the patient is fully positioned on the assembly of aprons and separator plates, the condition of the upper apron is changed so that the upper flight portion thereof in physical contact with the patient, will move in the same direction and at the same linear speed as the separator plates during retraction to transfer the patient from the bed or other surface back to the deck of the mechanism. The lower flight portion of the lower apron is fixed to the deck so that it remains stationary with respect to the surface of the bed also during the retraction of the separator and apron assembly. Accordingly, the lower flight portion of the upper apron slides relative to the upper flight portion of the lower apron with which it is in frictional contact. Such sliding motion between the aprons or belts is accommodated by the low friction characteristics of the teflon coating and the generation of unwanted static electricity is avoided by rendering the belts electrically conductive.

The basic transfer mechanism disclosed particularly in U.S. Pat. No. 3,579,672 and U.S. Pat. No. 3,765,037 possesses several unique features which are believed to be the basis for its immediate acceptance in the patient transfer field. Perhaps foremost of these features is the universal flexibility of the apron and separator assembly by which this assembly may conform to the irregular and unpredictable contour of the human anatomy reclined on a yieldable surface such as a bed mattress. This feature, combined with the facility for retaining to 130 mm. or less, the thickness of the plate-like transfer assembly movable under the patient to be transferred, enables a combined "softness" and "thinness" which makes it difficult for a bedridden patient to feel the assembly moving beneath him, not to mention a total absence of discomfort. Secondly, the provision for changing the condition of the upper apron relative to its separator plate not only enables the lateral loaded retraction of the assembly of aprons and plates to effect the transfer of the object or patient back to the deck of apparatus, but does so without in any way lifting the object or patient from the surface on which he is initially reclined and with which a patient identifies emotionally. As a result, the transfer of a hospital patient can be accomplished without subjecting the patient to any measure of fear or other emotional disturbance normally associated with patient handling operations.

Although object transfer apparatus of the type disclosed in the aforementioned U.S. patents has proven to be highly effective in the transfer of non-ambulatory hospital patients, there is need for improvement particularly from the standpoint of reduction of manufacturing costs, weight and size. While a need for reduction in manufacturing costs is essentially self-explained, the weight of prior machines has exceeded that of conventional hospital litters to such an extent that it is difficult for a nurse, for example, to manuever the machine within the space ordinarily available next to a bed in a hospital or nursing home environment. In particular, the strength required to change direction, initiate or stop movement of the machine is a practical deterrent to its use for the most routine of patient transfer operations.

With respect to size, the dimension most difficult to reduce and which also is perhaps most important from the standpoint of manueverability in and out of hospital rooms is the overall width of the machine. In this connection, the design of prior machines requires that the rear edge of the separators be retained on the front edge of the machine deck in the maximum extended position of the separators. Since in their retracted position the separators must overlie the machine deck, the separators can be no wider than the deck and thus cannot be extended for patient loading and unloading through a distance in excess of the width of the machine. The magnitude of this problem becomes apparent upon consideration of the fact that the optimum width of a litter for both patient support and manueverability from room to room in hospitals or like institutions should be on the order of 75 cm. However, because the width of a conventional hospital bed is often in excess of 100 cm., the maximum separator extension is less than desirable from the standpoint of extending the separators to a position where they are fully under the patient initially reclined in the center or on the far side of the hospital bed. As a result, it is often necessary to make use of bed sheets or the like to assist in loading a patient from a hospital bed onto the separator assembly for subsequent transfer back to the chassis deck of the transfer apparatus.

SUMMARY OF THE PRESENT INVENTION

In accordance with the present invention, the problems heretofore associated with excess weight and size as well as manufacturing costs of patient transfer apparatus of the type aforementioned are substantially alleviated by multi-stage or telescopic separator translating mechanism in which the load receiving separator assembly, having a width equal to or less than the width of the supporting deck, may be extended fully beyond the loading or front edge of the deck through a distance considerably greater than the overall width of the separators or deck. A guide plate having dimensions similar to those of the separators and positioned between the deck and the lower separator, forms part of a carriage assembly translatable in the direction of the separators. The guide plate moves sufficiently to span the gap left between the rear edge of the separators and the front edge of the deck at or nearing maximum separator extension.

The basic load transfer operation of the prior apparatus is retained by thin, conductive teflon-coated nylon aprons trained about flexible, plate-like upper and lower separators. In accordance with the present invention, however, the apron associated with the upper load receiving separator is established by a simple endless belt driven or held stationary relative to the upper separator by a drive roller mounted along the rear edge thereof. The lower separator is a double ended belt of similar material extending from one end anchored along the front edge of the deck over the lower separator and guide plate to a winding roller under the rear edge of the deck. The lower apron thus covers the top and bottom surfaces of both the guide plate and lower separator as these latter members are extended from the deck.

The separators and guide plate are driven through the respective translatory movement of these members by an unique single drive chain arrangement duplicated on opposite ends of the deck assembly and interconnected for concurrent movement with each other and with the winding roller for the lower apron. Movement of the upper apron or endless belt relative to the upper separator is controlled by a drive chain and sprocket arrangement, also duplicated on opposite ends of the deck assembly, coupled or decoupled with the separator-guide plate drive chains by a single clutch. Thus the required movements of the aprons, separators and guide plate are effected by a single drive source.

Among the objects of the present invention are therefore: the provision of an improved transfer mechanism for object transfer apparatus of the type disclosed in the aforementioned U.S. patents; the provision of such a transfer mechanism with an effective transfer loading and unloading reach distance in excess of the overall retracted dimension of the mechanism in the direction of transfer; the provision of such a transfer mechanism in which the distance through which respective apron and separator assemblies may be extended to load or unload a patient to be transferred approaches twice the dimension of either the separators or of the deck in the direction of transfer; the provision of such a mechanism by which the number of required parts and correspondingly the weight and cost of the mechanism is minimized; the provision of such a mechanism which enables simplification of assembly both of the overall mechanism and of the respective subassemblies thereof during manufacture as well as for maintenance and repair operations; the provision of an unique drive chain organization for effecting positively controlled movement of the upper and lower separators, the guide plate as well as the upper and lower aprons in relation to the separators; the provision of such a drive chain arrangement which contributes to effective operation of the mechanism throughout four modes of patient transfer operation with a single reversible drive source such as an electric motor and with a single two-position clutch; and the provision of an improved lightweight deck assembly.

Other objects and further scope of applicability of the present invention will be apparent from the detailed description to follow taken in conjunction with the accompanying drawings in which like parts are designated by like reference numerals.

DETAILED DESCRIPTION OF THE PREFERRED EMBODIMENTS

Figure 1:
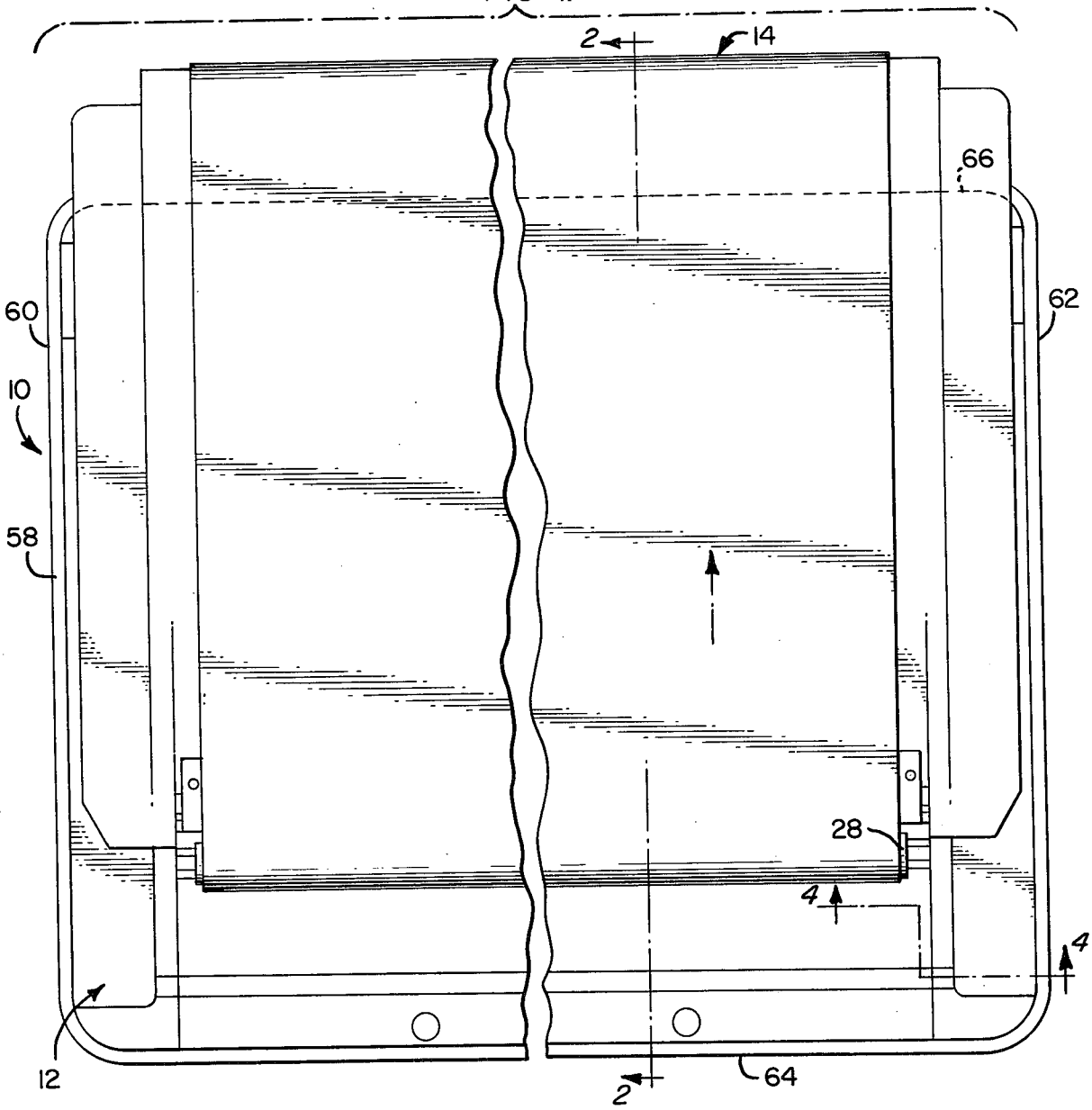
FIG. 1 is a fragmentary plan view of the improved patient transfer mechanism of the present invention.
Figure 2:
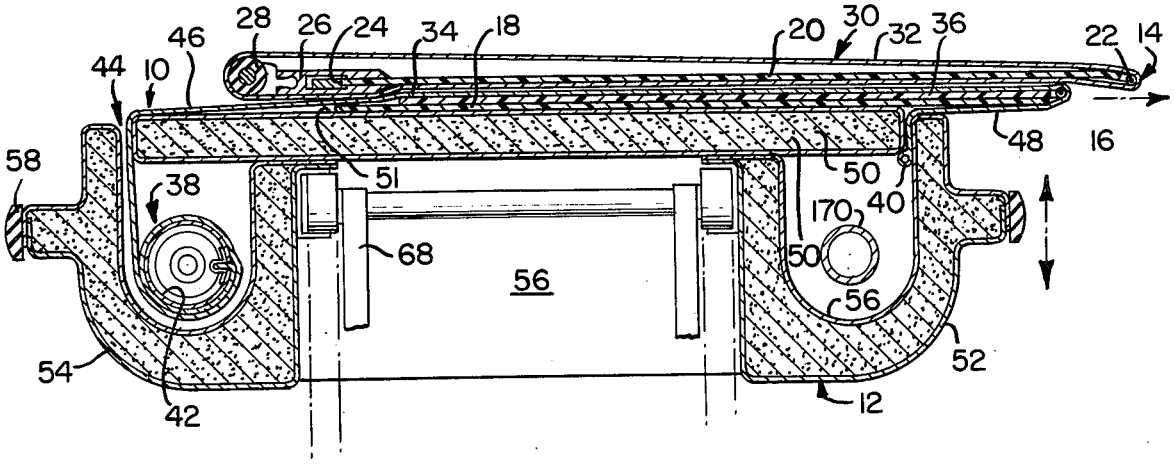
FIG. 2 is a cross-section taken on line 2—2 of FIG. 1.

In FIGS. 1 and 2 of the drawings, the improved transfer mechanism of the present invention is generally designated by the reference numeral 10 and includes as principal load or patient transferring components a deck assembly 12, an upper separator assembly 14, a lower separator assembly 16 underlying the upper separator assembly and a guide plate 18. The upper separator assembly 14 includes an upper separator plate 20 having a front edge 22 and a rear edge 24 joining with a retainer bar 26 supporting a drive roller 28. An upper apron 30 is trained about the top and bottom surfaces of the separator plate 20 and in the disclosed embodiment is defined by a simple endless belt having upper and lower flights 32 and 34, respectively. The lower separator assembly 16 similarly includes a lower separator plate 36, underlying and essentially coextensive with the upper separator plate 20, and a lower apron 38 in the form of a double ended belt having one end 40 secured along the front edge of the deck assembly 12 and its other end secured in similar fashion to a winding roller or cylinder 42 rotatably supported within the deck assembly at the rear edge thereof. As shown, the lower apron 38 extends from the winding cylinder 42 through a slot 44 along the rear edge of the deck assembly 12 in an upper flight portion 46 over the lower separator 36 about the front edge thereof and through a lower flight portion 48 to the anchored end 40.

With respect to the nomenclature used in the description of the components shown in FIGS. 1 and 2 of the drawings, it is to be noted that the work "separator" is a term of art used to identify the flexible, plate-like support about which the respective aprons are trained and which functions principally to retain the flight conformation of the respective aprons. Although these members therefore separate the flight portions of the aprons, they also function more basically as a support for the aprons. Hence, the terms "separator" and "support" as used herein and in the appended claims are intended to define the plate-like members 20 and 36 or their equivalent. Likewise, the term "apron" as used herein and in the appended claims is intended to define an extremely thin fabric-like covering or the equivalent thereof, preferably of teflon-coated conductive nylon and which may be established either by an endless belt or a double ended belt.

As may be seen in FIGS. 1 and 2, the deck assembly 12 is formed having a deck plate 50 defining a planar deck surface 51 and supported by longitudinal front and rear depending beam-like members 52 and 54 suitably secured to the deck plate 50 by riveting, welding, or by adhesion and also by similar means to bulkheads 56 at opposite ends. Although the bulkheads 56 are formed of metal castings for reasons which will be apparent from the description to follow, the deck plate 50 and beam members 52 and 54 are respectively formed having a relatively thin exterior shell, for example, the shell 56 of the member 52, either of metal or of plastic, and which is filled with an essentially non-compressible foam plastic such as polyurethane. This construction of the deck assembly effects significant reduction in weight without compromise in needed rigidity and strength. The shells of the beam members 52 and 54 as well as of end caps are circumscribed by a continuous bumper rail 58 which defines the outer lateral extremities of the mechanism (assuming the separator assemblies 14 and 16 to be retracted to a position completely overlying the deck surface 51). As may be appreciated by reference to FIG. 1, the lateral dimensions of the deck, as defined by the bumper 58, are intended to approximate a conventional litter and thus are on the order of 180 cm. from the bumper 58 at the left end 60 of a mechanism to the bumper at right end 62 thereof and on the order of 75 cm. in the direction of separator travel or from the rear edge 64 to the front edge 66.

It is contemplated that the deck assembly 12 will be supported from an appropriate vertically adjustable wheeled base 68 only partially shown in FIG. 2. A more complete illustration of the base than that shown in FIG. 2 is not included since details of the base are not necessary for a complete understanding of the transfer mechanism to which the present invention relates.

To facilitate an understanding of the structural components of the present invention by which the aforementioned transferring components are physically interconnected with each other as well as with other components to be described, reference is made to FIGS. 3A-3D of the drawings in which the principal transferring components are depicted schematically in four modes of transfer operation. Thus in FIG. 3A, the upper and lower separator assemblies 14 and 16 are shown advancing from a retracted position in which they overlie the deck surface 51 to an extended position over a hospital bed or other surface (not shown) and under a patient to be transferred in a "load" mode of operation. In this mode, the separators 20 and 36 are being advanced outwardly or to the right as shown in FIG. 3 in the direction of the arrows V at one unit of velocity. In order to isolate any frictional contact of the upper separator 20 with the patient to be loaded, the upper apron 30 is rotatably driven about the upper separator 20 in a direction and at a velocity such that the upper flight 32 of the apron 30 is retained stationary relative to the patient, the bed and the deck surface 51. Thus the lower flight 34 of the upper apron 30 is driven in the same direction as the separator but at a velocity 2V or twice that of separator translation. The lower flight 48 of the lower apron 38 will be held stationary relative to the deck due to the end 40 thereof being fixed along the front edge of the deck. Correspondingly, the upper flight 46 of the lower apron 38 will be payed out from the roller 42 in the direction of separator translation but again at two units of velocity or 2V. As a result of this operation, the separators will find their way under a patient reclining on a surface because of the frictional isolation thereof from the patient by the upper flight 32 of the upper apron 30 and a similar frictional isolation of the lower separator from the bed or other surface by the lower flight 48 of the lower apron 38.

To enable the separator assemblies 14 and 16 to extend beyond the front edge 66 of the deck by a distance in excess of the width of the separators 20 and 36, the guide plate 18 is translated outwardly in the direction of separator translation but at one-half the velocity thereof or V/2 and correspondingly through one-half the distance travelled by the separator plates 20 and 36. As a result, the separators 20 and 36 may be extended through a distance approaching twice their width or twice the width of the deck with the gap between the rear edges of the separators 20 and 36 and the front edge of the deck being spanned by the guide plate 18.

Figure 3A:
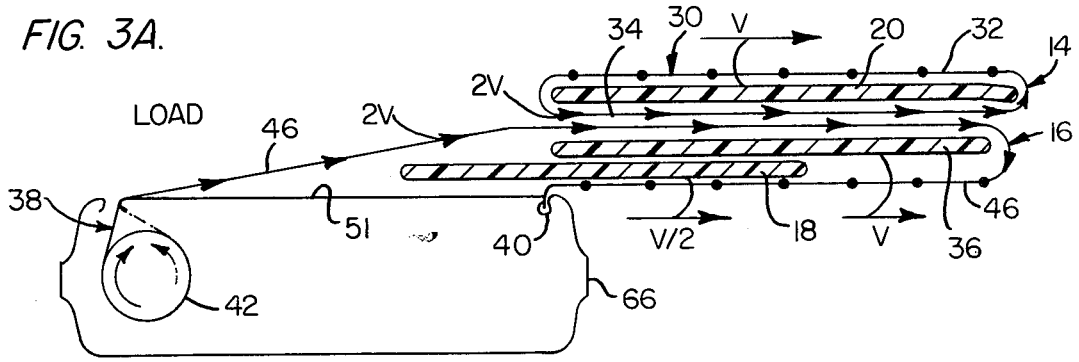
FIGS. 3A–3D are schematic cross-sectional views illustrating the direction and velocity of transfer components during four modes of operation respectively.
Figure 3B:
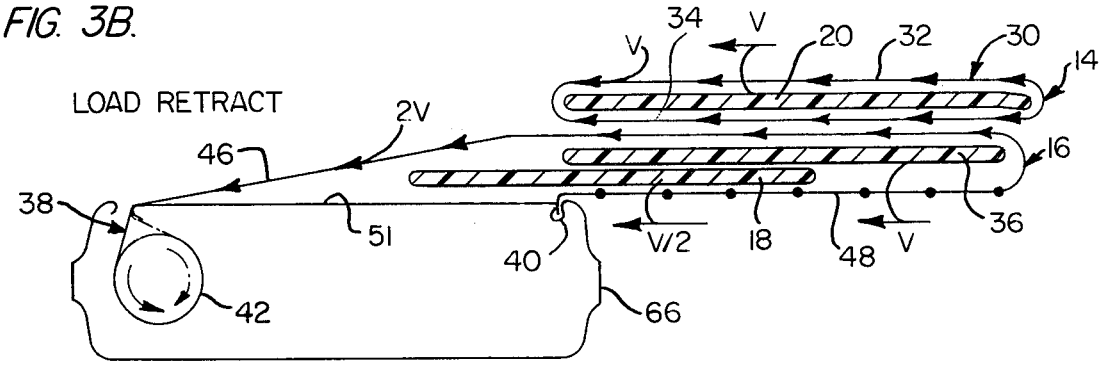

Once the separators 20 and 36 have advanced to a position wherein the patient to be transferred is located on the upper separator assembly 14, condition of operation is changed to the "load retract" mode shown in FIG. 3B. As indicated by the arrows, translation of the separators 20 and 36 as well as the guide plate 18 and the lower apron 38 is simply the reverse of that described above with respect to the load mode of operation in FIG. 3A. In this instance, however, it will be noted that the upper apron 30 does not rotate relative to the upper separator 20 and thus moves as a unit with the upper separator with both upper and lower flights 32 and 34 moving in the direction back toward the deck at a velocity V.

Figure 3C:
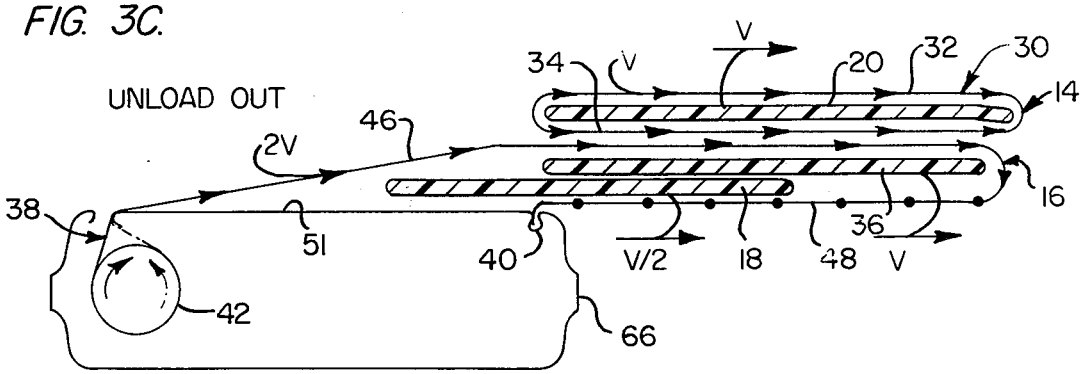
Figure 3D:
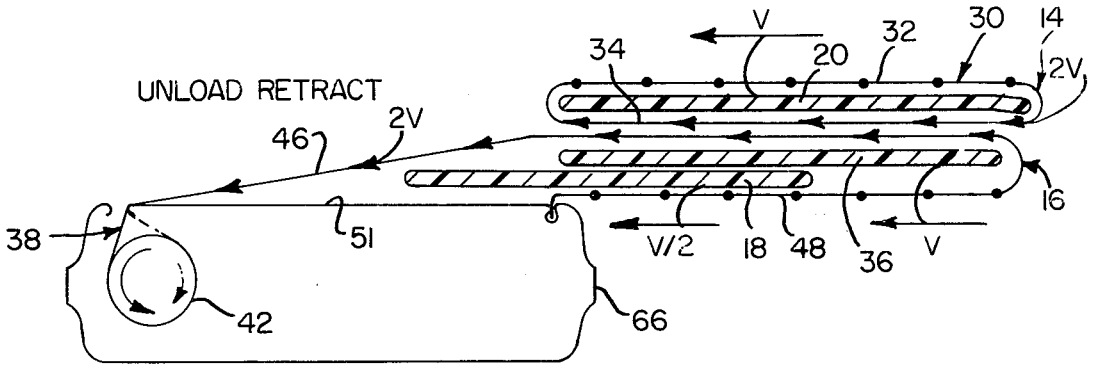

To transfer a patient from the transfer mechanism with the separators 20 and 36 fully overlying the guide plate 18 and the deck surface 51 outwardly beyond the front edge 66 of the deck to a bed or other surface, the transfer components advance in the direction of the arrows at the respective velocities V, 2V or V/2 in the "unload out" mode depicted by FIG. 3C. The unload out mode of operation will be observed as a true reversal of the load retract mode described with respect to FIG. 3B; that is, the upper apron moves as a unit with the upper separator and direction of all component movement is reversed. Similarly, the "unload retract" mode of operation depicted in FIG. 3D is a true reversal of the load mode of operation described in connection with FIG. 3A. This latter unload retract mode of operation is employed to withdraw the separator assemblies 14 and 16 from a position under a patient or object after transfer of the patient from the deck to another surface.

Figure 7:
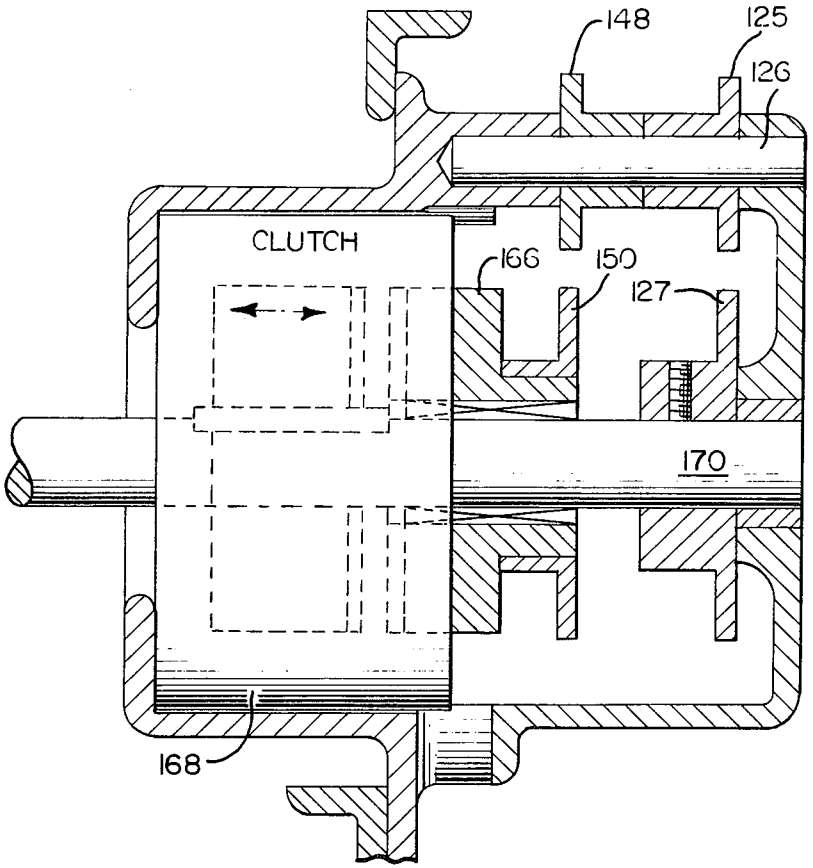
FIG. 7 is an enlarged fragmentary cross-section taken on line 7—7 of FIGS. 5 and 6.
Figure 8:
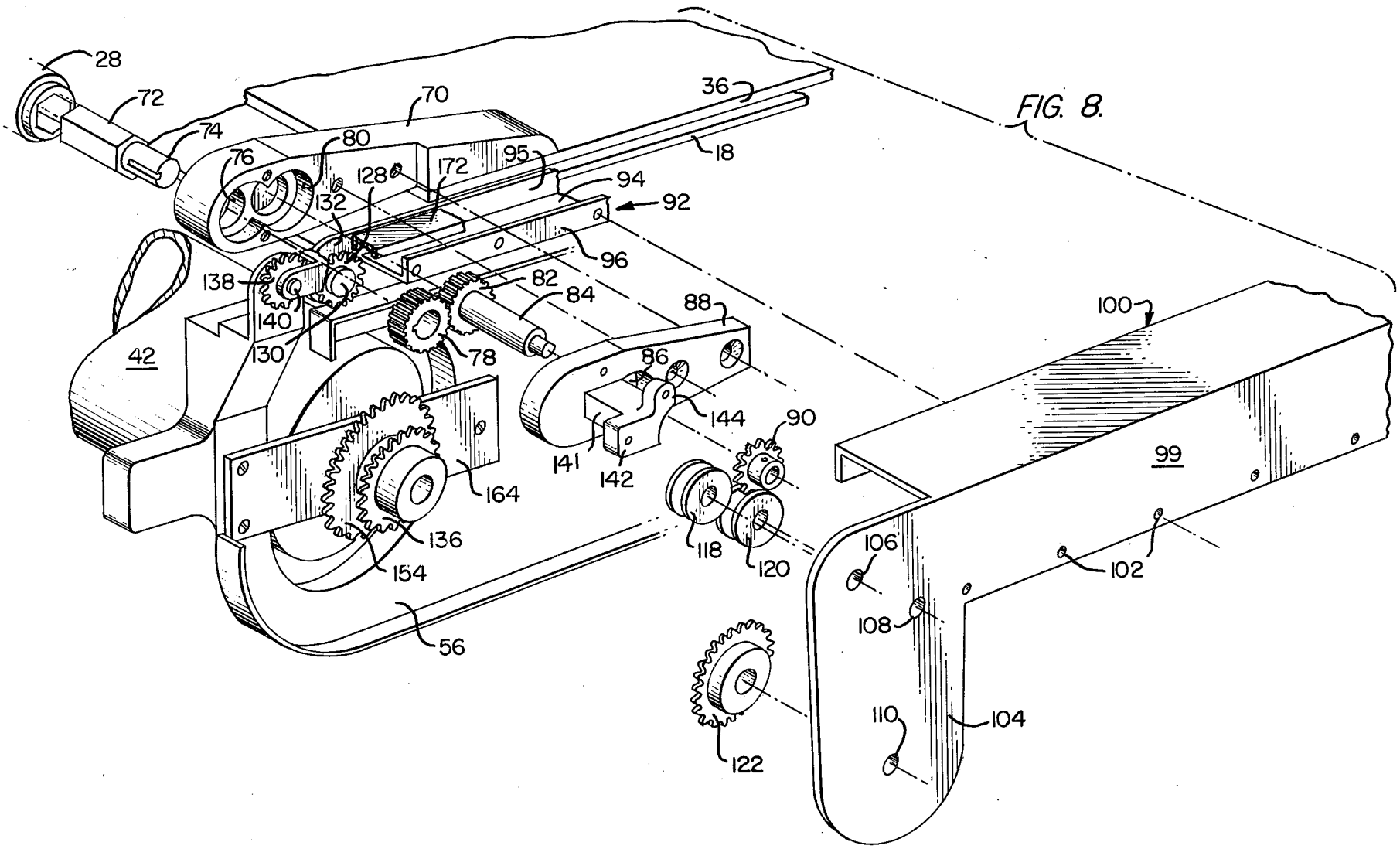
FIG. 8 is a fragmentary exploded perspective view illustrating components shown generally in FIG. 4.

The manner in which the separators 20 and 22 and the guide plate 18 are assembled on the deck 12, translated in the four operational modes described above and driven in synchronism with rotation of the upper apron drive roller 28 as well as the lower apron winding roller 42, in one embodiment of the present invention, may be understood by reference to FIGS. 4–8 of the drawings, keeping in mind that the illustrated components are essentially duplicated at the bulkhead 56 on opposite ends of the deck assembly 12. In FIG. 8, the lower separator 36 is shown connected at its rear corners to the underside of a gear box housing 70 by suitable means such as counter sunk screw bolts (not shown). The upper apron drive roller 28, which is secured to the upper separator 20 in a manner to be described below, is coupled with a non-circular or splined stub shaft 72 having a bearing extension 74 extending through a bearing aperture 76 to be keyed with an output gear 78 of a reversing gear pair received in a gear well 80 of the housing 70. The output gear 78 is in mesh with an input gear 82 on the end of a drive shaft 84 extending through a bearing aperture 86 in a gear housing cover 88 and keyed with a drive sprocket 90. Although the manner in which the drive sprocket 90 is driven to rotate the upper apron drive roller will be described in more detail below, it will be apparent from the organization of parts described that translating movement of the gear box 70 will be accompanied by movement of the lower apron 36 as well as the upper apron 20 by virtue of the connection thereof to the drive roller 28.

Figure 15:
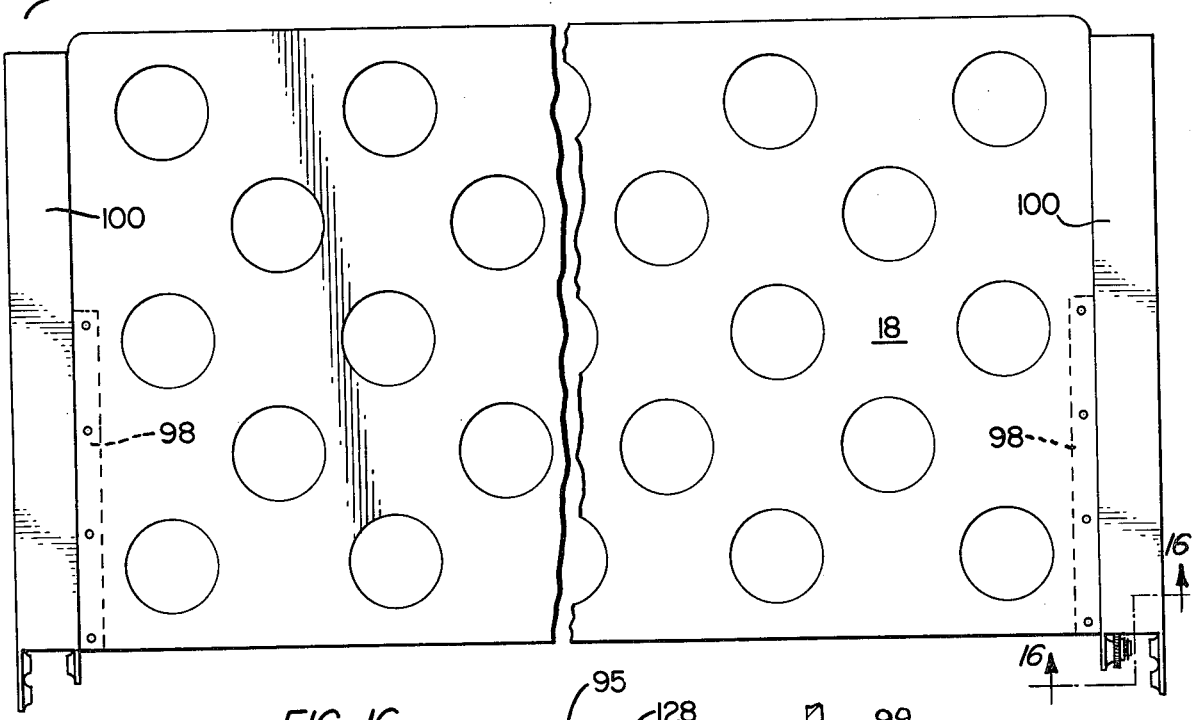
FIG. 15 is a similar plan view illustrating the guide plate and carriage assembly of the invention.

The guide plate 18 forms part of a carriage assembly illustrated in FIG. 15 and as such is secured at its ends to a channel-shaped end connector 92 having a horizontal web 94 and inner and outer vertical flanges 95 and 96, respectively. A cleat 98 (see FIG. 16) projects inwardly of the inner flange 95 along the major portion of the connector 92 in the plane of the web 94 and is secured to the bottom of the guide plate 18 by appropriate means such as screws as shown. The flange 96 of the end connector 92 is formed with apertures for securement directly to an outer flange 99 on a carriage end bracket 100, the flange 99 having spaced apertures 102 aligned with correspondingly spaced apertures in the end connector flange for accommodating rivets, bolts or screws.

Figure 4:
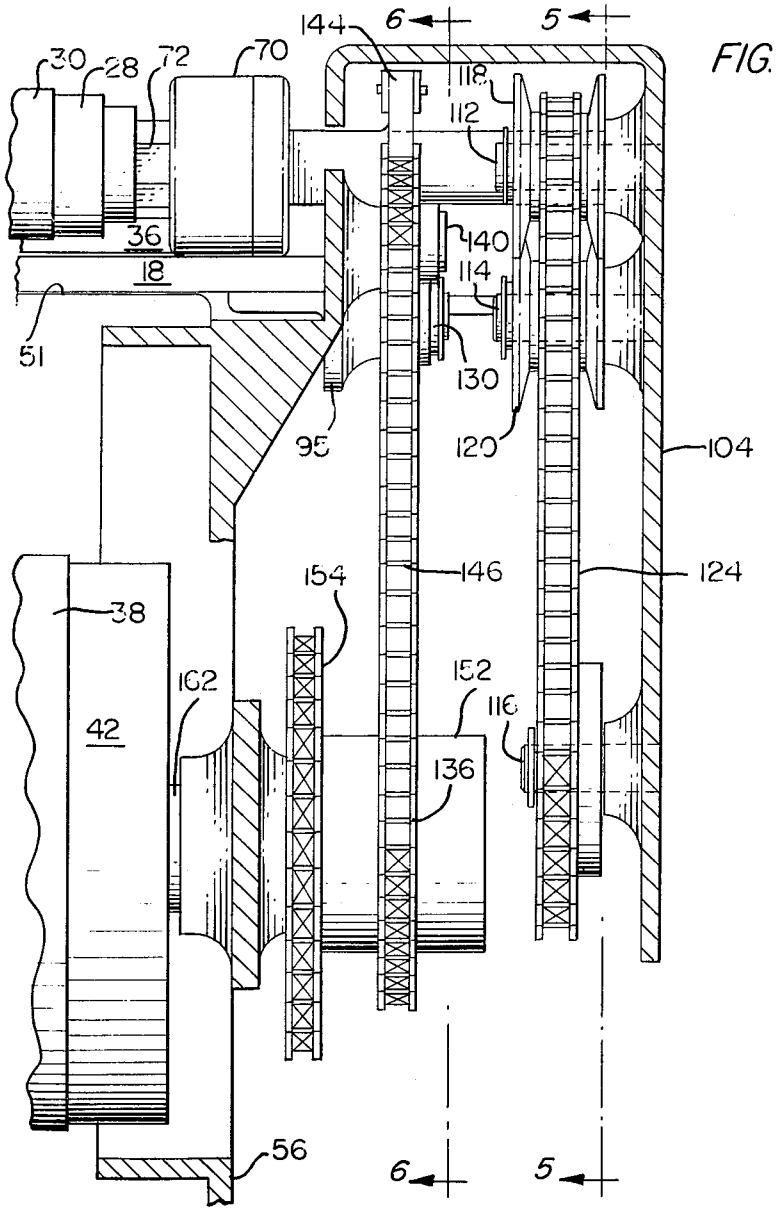
FIG. 4 is an enlarged fragmentary cross-section taken on line 4—4 of FIG. 1.
Figure 5:
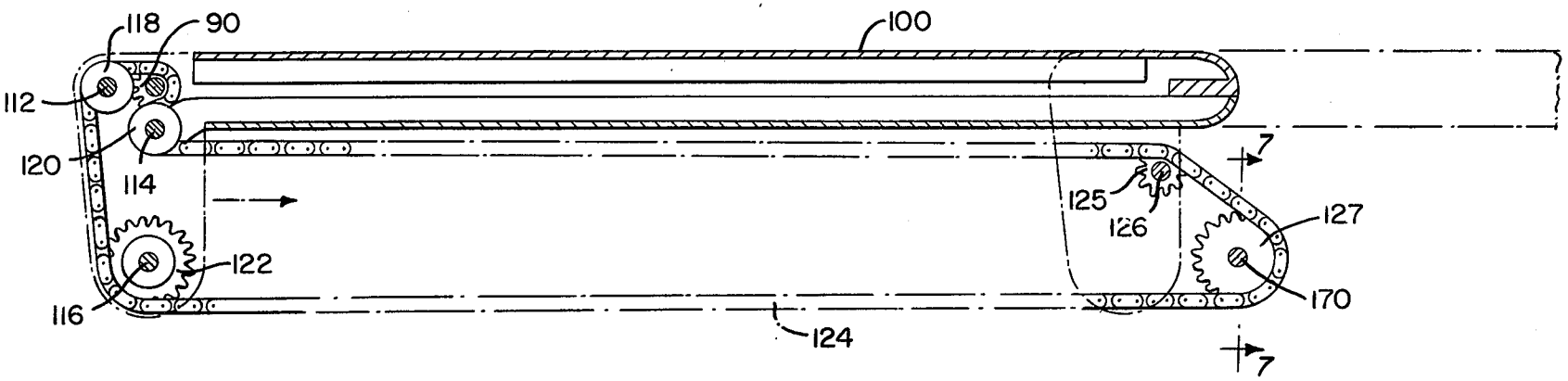
FIG. 5 is a cross-section taken on line 5—5 of FIG. 4 but at a reduced scale.

The flange 99 of the carriage end bracket 100 is provided at its rear end with a depending stub shaft mounting portion 104 formed with three bores 106, 108 and 110. These bores extend inwardly through bosses (see FIG. 4) for mounting stub shafts 112, 114 and 116, respectively. A pair of guide rollers 118 and 120 are journalled respectively on the stub shafts 112 and 114 whereas an idler sprocket 122 is journalled on the stub shaft 116. The guide rollers 118 and 120 as well as the idler sprocket 122, as shown in FIGS. 4, 5 and 8, are supported by the stub shaft mount 104 to lie in the same plane as the upper apron drive roller sprocket 90 and as such, support an endless upper apron drive chain 124 trained about the idler sprocket 122, upwardly around the guide roller 118, forwardly about the sprocket 90, rearwardly and downwardly around the guide roller 120 and forwardly about an idler sprocket 125 journalled on a shaft 126 (see FIG. 5) supported by the bulkhead 56 thus to establish in the chain 124 a reversing double loop about the drive sprocket 90 and roller 120. From the idler sprocket 125, the chain extends downwardly about a drive sprocket 127 and back to the idler sprocket 122.

Figure 6:
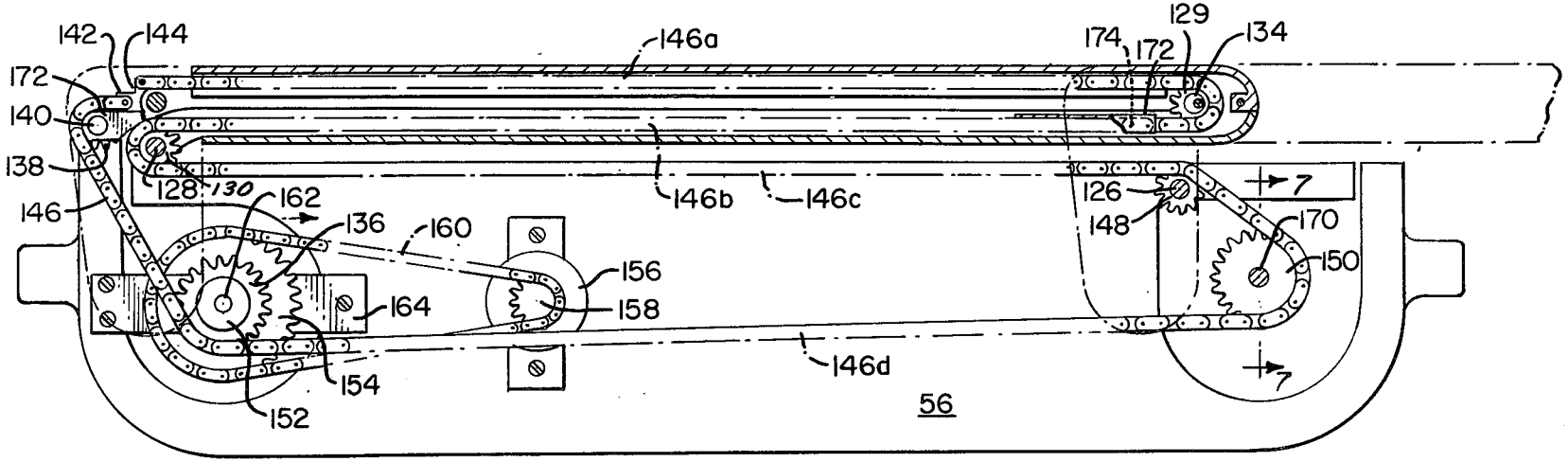
FIG. 6 is a cross-section taken on line 6—6 of FIG. 4 also at a reduced scale.

In addition to the rollers 118, 120 and idler sprocket 122, the assembly movable with the guide plate 18 supports two additional sprockets 128 and 129 (see FIGS. 6 and 8). The sprocket 128 is journalled on a stub shaft 130 secured in a bearing flange extension 132 (FIGS. 8 and 13) of the inner vertical flange 95 of the channel-shaped end connector 92. The sprocket 129 is journalled on a shaft 134 extending between the flange 99 of the carriage end bracket 100 and the inner flange 95 of the guide plate end connector 92. Thus it will be seen that the sprockets 128 and 129 are carried by and moved with the carriage assembly including the guide plate 18 end connector 92 and end bracket 100.

It will be seen by reference to FIGS. 4, 6 and 8 of the drawings that the carriage assembly mounted sprockets 128 and 129 are coplanar with respect to each other and with respect to a drive sprocket 136, rotatable on an axis fixed with respect to the bulkhead 56, and idler sprocket 138 journalled on a shaft 140 also supported by the bulkhead 56. Also it will be noted that the gear box cover 88 is provided with an outward projection 141 supporting at its end, a pair of chain link connecting bosses or lugs 142 and 144. As shown most clearly in FIGS. 4 and 6 of the drawings, the connecting bosses 142 and 144 are coplanar with the sprockets 128, 129, 136 and 138 and are connected to opposite ends of a separator-guide plate translating drive chain 146. Although the drive chain is technically double-ended, the lugs 142 and 144 function as a link so that the organization of the lugs and the chain 146, in reality, establish an endless translating drive chain.

The flight configuration of the chain 146 is important to operation of the transfer mechanism of the present invention. It is equally important, therefore, that the orientation and function of each flight portion or run therein be understood. Proceeding from the end of the chain 146 connected to the boss 144, the chain 146 extends through a horizontal flight **146*a* about the sprocket 129 rearwardly through a flight 146*b* about the sprocket 128, and forwardly through a flight 146*c* to an idler sprocket 148 journalled on the shaft 126 fixed to the bulkhead 56. From the sprocket 148, the chain 146 extends about a sprocket 150, also rotatable about an axis fixed with respect to the bulkhead 56, rearwardly through a return flight 146*d*, about the drive sprocket 136 and upwardly about the idler sprocket 138 to the other end which is connected to the lug 142 which is aligned essentially with the first mentioned flight 146*a***.

As shown in FIGS. 4 and 6 of the drawings, the drive sprocket 136 for the separator and guide plate translating drive chain 146 is fixed on a common hub 152 with a larger chain driven sprocket 154. The driven sprocket 154 is located inwardly of the drive sprocket 136 and is coupled with a reversible motor or drive source 156 by a relatively small drive sprocket 158 and a drive chain 160. Also as shown in FIG. 4, the hub 152 carrying the sprockets 136 and 154 is keyed for rotation with a shaft 162 journalled in a bracket 164 supported by the bulkhead 156. The shaft 162 is also keyed with the winding roller 42 to which one end of the lower apron 36 is connected. Accordingly, the direction of rotation of the drive 156 will at all times be the same as the direction of rotation of the sprockets 136 and 154 as well as the winding roller 42 which operates to pay-out or take-in the upper flight 46 of the lower apron in the manner described above with respect to FIGS. 3A–3D. Reversible electric motors are well known in the art and serve admirably with appropriate control systems as the power source for driving the several components of the transfer mechanism of the invention. It is contemplated, however, that other types of reversible drive sources, including a hand crank, for example, might be used.

As shown in FIG. 7, in conjunction with FIG. 5 and 6, the drive sprocket 127, about which the upper apron drive chain 124 is trained, is coaxial with the sprocket 150 engaged by the separator-guide plate translating drive chain 146. As shown in FIG. 7, the sprocket 150 is keyed to one plate 166 of a clutch 168 and journalled for rotation about a torque transmitting shaft 170 extending along the length of the deck assembly through the hollow beam member 52 thereof. As a result of this organization, when the clutch 168 is in a disengaged position, the sprocket 150 will rotate freely on the shaft 170, which along with the sprocket 127 keyed thereto, will remain stationary. When the clutch 168 is engaged, however, the shaft 170 and sprocket 127 will rotate concurrently with the sprocket 150.

In view of the organization of the sprockets 136 and 154, the shaft 162 and torque transmitting capability of the winding roller 42, torque developed by the motor 156 will be transmitted to the sprocket 154 at one end of the deck assembly along the winding roller 42 to duplicates of the sprockets 136 and 154 supported by the bulkhead 56 at the other end of the machine. Torque transmitted to the sprocket 150 by the driven chain 146 will be transmitted, only when the clutch 168 is engaged, to the shaft 170 and sprockets 127 duplicate at opposite ends of the deck assembly. Because of frictional load characteristics associated with the chain 146, the shaft 170 will not rotate on its axis unless the clutch 168 is engaged. This operation can be augmented however, by a combination clutch-brake if desired. The duplicate of the sprocket 150 on the opposite end of the deck assembly will be merely journalled for free rotation on the shaft 170 so that the torque needed to drive the sprockets 127 on opposite ends of the shaft 170 will be transmitted to the shaft only on the end at which the clutch 168 is located.

An additional component contributing to operation of the drive organization illustrated in FIGS. 4–8 is a link or its equivalent shown partially in FIGS. 6 and 8 and designated in these figures by the reference numeral 172. The link 172 is shown to be of inverted channel-shaped cross-section and is secured at one end against movement with respect to the bulkhead 56 by the stub shaft 140 on which the idler sprocket 138 is journalled. The link 172 extends for the length of the flight **146*b* of the chain 146 and is secured at its opposite end to a chain link 174 located in the flight 146*b* near the sprocket 129 when the separators 20 and 36 as well as the guide plate 18 are essentially superimposed on the deck surface 51 in a retracted position. The link 172 thus prevents movement of the chain flight 146*b* relative to the bulkhead 56. The construction of the link 172 as an essentially channel-shaped member overlying the chain flight 146*b* is desirable from the standpoint of minimizing interference with components translated with respect to the bulkhead 56. In point of function however, other suitable means for fixing the front end of the flight 146*b*** to the deck assembly might be used.

In view of the organization of drive components thus shown in FIGS. 4–8 of the drawings, operation of the drive chains 124 and 146 to effect the four modes of operation depicted by FIGS. 3A–3D of the drawings may be understood. During the load mode of operation depicted by FIG. 3A, and with reference to the orientation of components illustrated in FIGS. 3, 5 and 6, the drive source 156 is driven to rotate the sprockets 158, 154 and 136 and 138 in a clockwise direction, thus advancing the separator drive chain flight **146*a* forwardly or from left to right, as shown in FIG. 6, at one unit of velocity V. The connection of the chain 146 to the gear box housing 70 in this flight will operate to translate both the upper and lower separators 20 and 36 outwardly at that velocity. Because the chain flight 146*b* is held against movement by the channel link 172, and because of the loop in the chain 146 extending about the sprocket 128 carried with the guide plate 18, forward movement of the chain in the flight 146*c* at a velocity V will advance the sprocket 128 and guide plate 18 forwardly at a velocity V/2 or at one-half the velocity of drive chain travel in the flights 146*a*, 146*c* and 146*d*. Also, the direct connection of the sprocket 136 to the winding roller 42 will operate to payout the upper flight portion 46 of the lower apron 38 in a manner described above with respect to FIG. 3A. It will be apparent, of course, that movement of the guide plate 18 at one-half the velocity of the chain flight 146*a*, for example, will bring about movement of the guide plate through only one-half the distance travelled by the gear box 70 and separators 20 and 36** attached thereto.

As mentioned above, the load mode of operation requires that the upper apron 30 be rotated about the upper separator 20 in a manner to retain the upper flight 32 of the upper apron 30 stationary relative to the deck surface 51. To achieve this condition in the upper apron 30, the roller 28 must be rotated in a direction which is the reverse of drive motor rotation or in a counterclockwise direction as shown in FIGS. 3A and 5 of the drawings, for example. To effect such rotation of the roller 28 and movement of the apron 30 relative to the separator 20 in the load mode of operation, the clutch 168 will be engaged so that the sprocket 127 will be rotated in a clockwise direction, as seen in FIG. 5, thus driving the chain 124 to rotate the roller drive sprocket 90 also in a clockwise direction. Clockwise direction of the sprocket 90 and corresponding clockwise rotation of the gear 82, however, will bring about a counterclockwise rotation of the gear 68 and roller 28 keyed thereto. While the relative rotation of the roller 28 and the sprocket 90 should therefore be apparent, it is to be noted further with respect to FIG. 5 of the drawings that the orientation of the guide rollers 118 and 120 together with the sprocket 90 enables the sprocket 90 to be driven continuously by the endless drive chain 124 even though the sprocket 90 moves with the separators 20 and 36 relative to the guide plate and carriage end bracket 100 on which the rollers 118 and 120 are journalled with the idler sprocket 122. In particular, and as the chains 124 and 146 are simultaneously driven, the sprocket 90 will move forwardly away from the guide rollers 118 and 120 at a relative velocity of one-half the velocity of separator translation. Because the idler sprockets 126 and 127 at the forward end of the bulkhead 56 are journalled on axes fixed with respect to the deck assembly 12, relative movement of the sprocket 90 and the guide rollers 118 and 120 will merely develop a pair of compensating loops in the drive chain 124, one extending from the rollers 118 and 120 about the drive sprocket 90 and the other from the sprockets 90 and 125 back about the guide roller 120. Accordingly, one such loop elongates while the other shortens to avoid alteration of the rotational drive imparted to the sprocket by the chain 124.

In the load retract mode of operation depicted by FIG. 3B of the drawings, operation of the lower separator 36, the guide plate 18 as well as the lower apron 38 is a simple reversal of that in the load mode. Thus in the load retract mode, the motor 56 is reversed to drive the sprockets 158, 136 and 138 in a counterclockwise direction causing the chain 146 to pull the gear box 70 and associated separators 20 and 36 rearwardly through the flight 146*a* of the drive chain 146. Again because of the flight 146*b* being secured against movement by the channel link 172, rearward movement in the chain flight 146*a* will cause rearward movement of the sprocket 129 carried by the carriage end bracket 100 at a velocity one-half that of chain travel in the flight 146*a*. Since the upper apron 30 does not rotate relative to the separator 20 in the load retract mode, the drive roller 28 is retained in a stationary or non-rotating condition simply by decoupling the clutch 168. Operation of the chain drive arrangement to effect the unload out and load retract modes of operation is believed clear from the foregoing and the description previously given with respect to FIGS. 3C and 3D. Hence no further discussion of these modes of operation is necessary.

Figure 9:
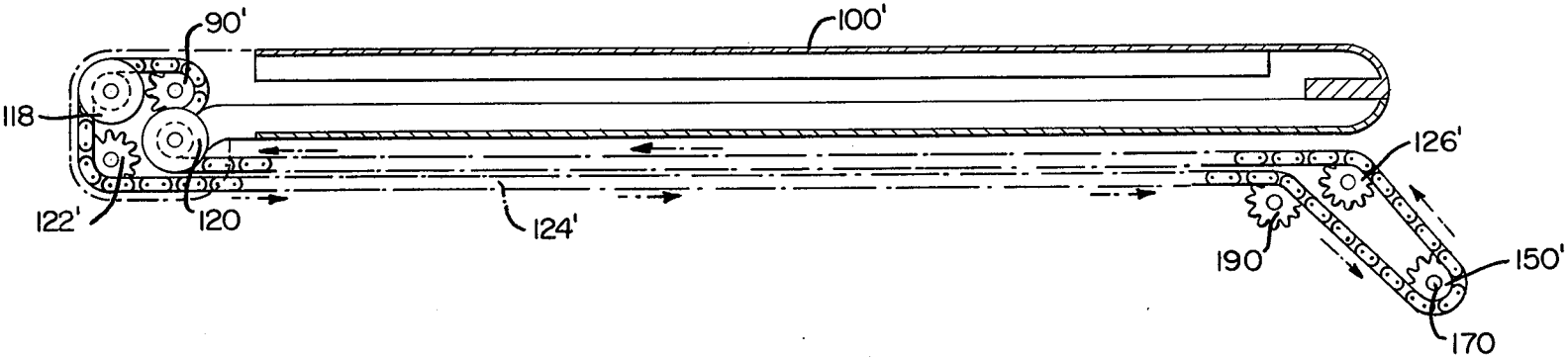
FIG. 9 is a fragmentary cross-section similar to FIG. 5 illustrating a modified embodiment of the upper apron drive chain organization of the invention.
Figure 10:
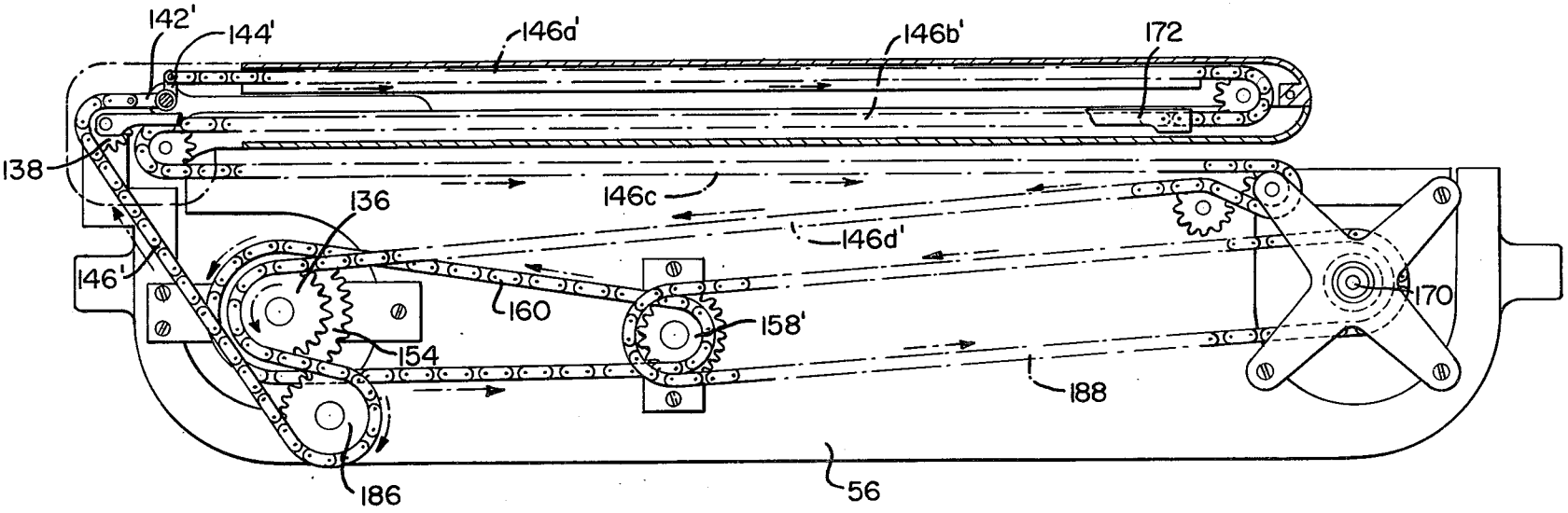
FIG. 10 is a fragmentary cross-section similar to FIG. 6 but illustrating a separator-carriage assembly drive chain arrangement for the modified embodiment of FIG. 9.
Figure 11:
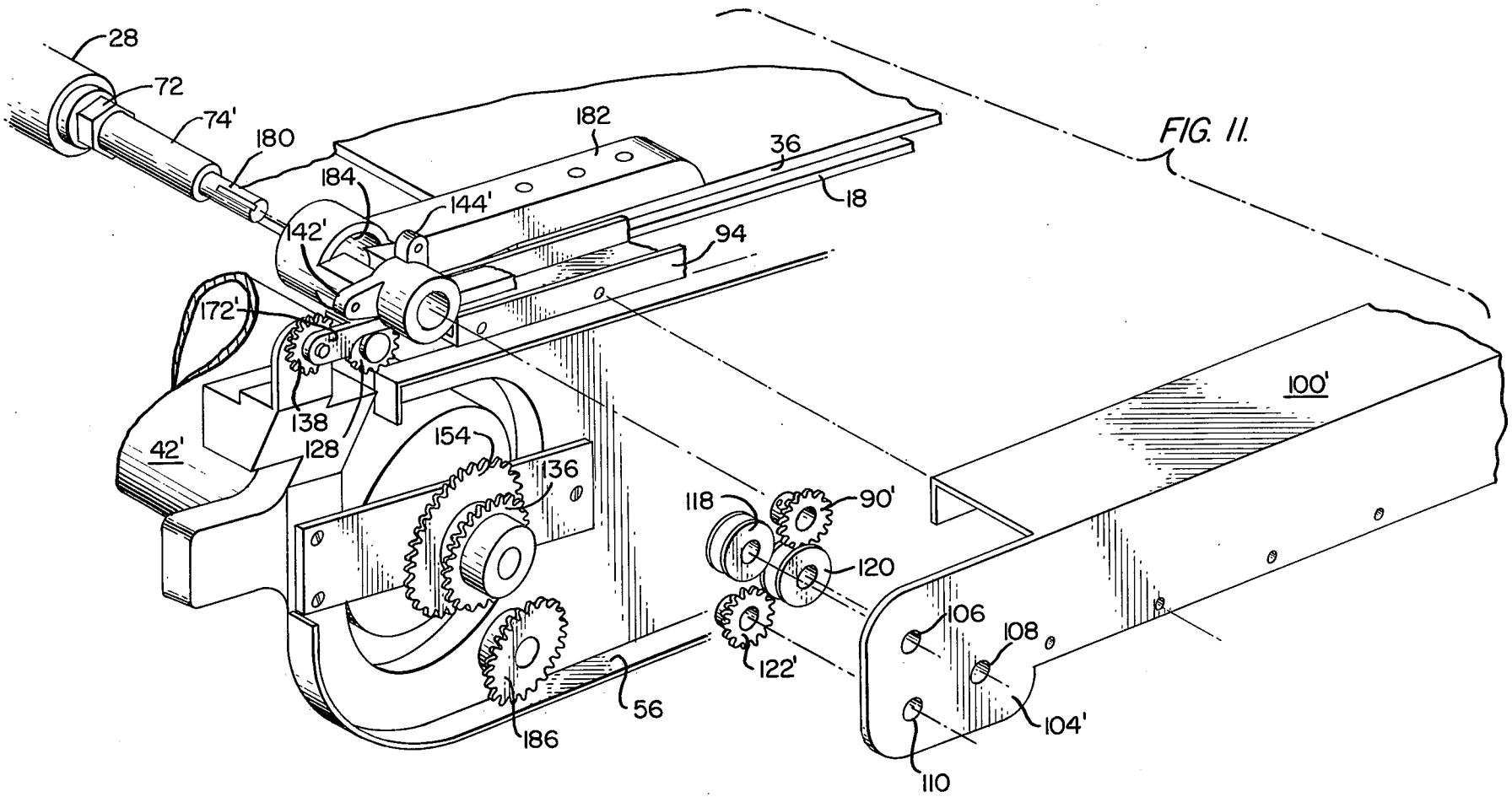
FIG. 11 is an exploded fragmentary perspective view similar to FIG. 8 but illustrating components modified for the drive chain arrangement shown in FIGS. 9 and 10.

An alternative embodiment incorporating a modified drive chain organization is illustrated in FIGS. 9–11 of the drawings. In these figures, parts which are directly interchangeable with parts previously described above with respect to FIGS. 4–8 are identified by the same reference numeral whereas parts having corresponding functions but which differ slightly in structure are designated by similar reference numerals but which are primed. Thus in FIG. 11, the upper apron drive roller 28 is again shown splined to a stub shaft 72 but in this instance having an elongated bearing extension 74' terminating at its end in a reduced diameter shaft portion 180 keyed directly to the roller drive sprocket 90'. The gear box 70 of the previous embodiment is replaced by a separator bracket 182 fixed to the lower separator 36 in the manner described above with respect to the gear box 70 and having a simple sleeve journal 184 for receiving the elongated shaft portion 74' of the stub shaft 72. The chain connecting bosses 142' and 144' extend from the outer portion of the bearing journal 144 in a manner substantially identical to that of the previously described embodiment. It will be observed by a comparison of FIG. 11 with FIG. 8 that the reversing gears 78 and 82 of the previous embodiment are eliminated in this modified embodiment.

Inasmuch as the direction of torque supplied to the roller 28 must be the reverse of drive torque employed to advance the upper flight 146*a'* of the drive chain 146 in both the load and unload retract modes of operation depicted by FIGS. 3A and 3B, this operational feature is accommodated by the embodiment of FIGS. 9–11 by training the lower flight 146*d'* of the drive chain 146' over the top of the drive sprocket 136 and about an idler sprocket 186 added to the embodiment of FIGS. 9–11. Thus, counterclockwise rotation of the motor and motor drive sprocket 158' will effect counterclockwise rotation of the sprockets 154 and 136 to effect drive chain travel in the same direction resulting from clockwise rotation of the motor in the previously described embodiment. In order to account for a paying out of the lower apron 38 during forward movement of the bracekt 182 along the upper flight 146*a'* shown in FIG. 10, the lower apron 38 is wrapped on the roller 42' in the opposite direction. Hence the respective rotational direction of the drum 42 shown in FIGS. 3A–3D will be reversed for the drive organization of FIGS. 14–16. This reverse winding of the lower apron 38 is depicted by dash lines and dashed arrows in each of FIGS. 3A–3D. A separate drive chain 188 is shown in FIG. 10 to transmit torque from the motor drive sprocket 158' to the clutch sprocket 150. The use of the separate drive chain 188 reduces loading on the translating drive chain 146' and also facilitates use of sprocket sizes not necessarily correlated to the sprockets driven by the chain 146'. In all other respects, the embodiment of FIGS. 9–11 is the same as the embodiment of FIGS. 4–8 so that the operation thereof need not be described further. It will be apparent, however, that the elimination of the gear box with the drive arrangement shown in FIGS. 9–11 greatly simplifies the transmission of drive torque to the upper apron drive roller 28.

Figure 12:
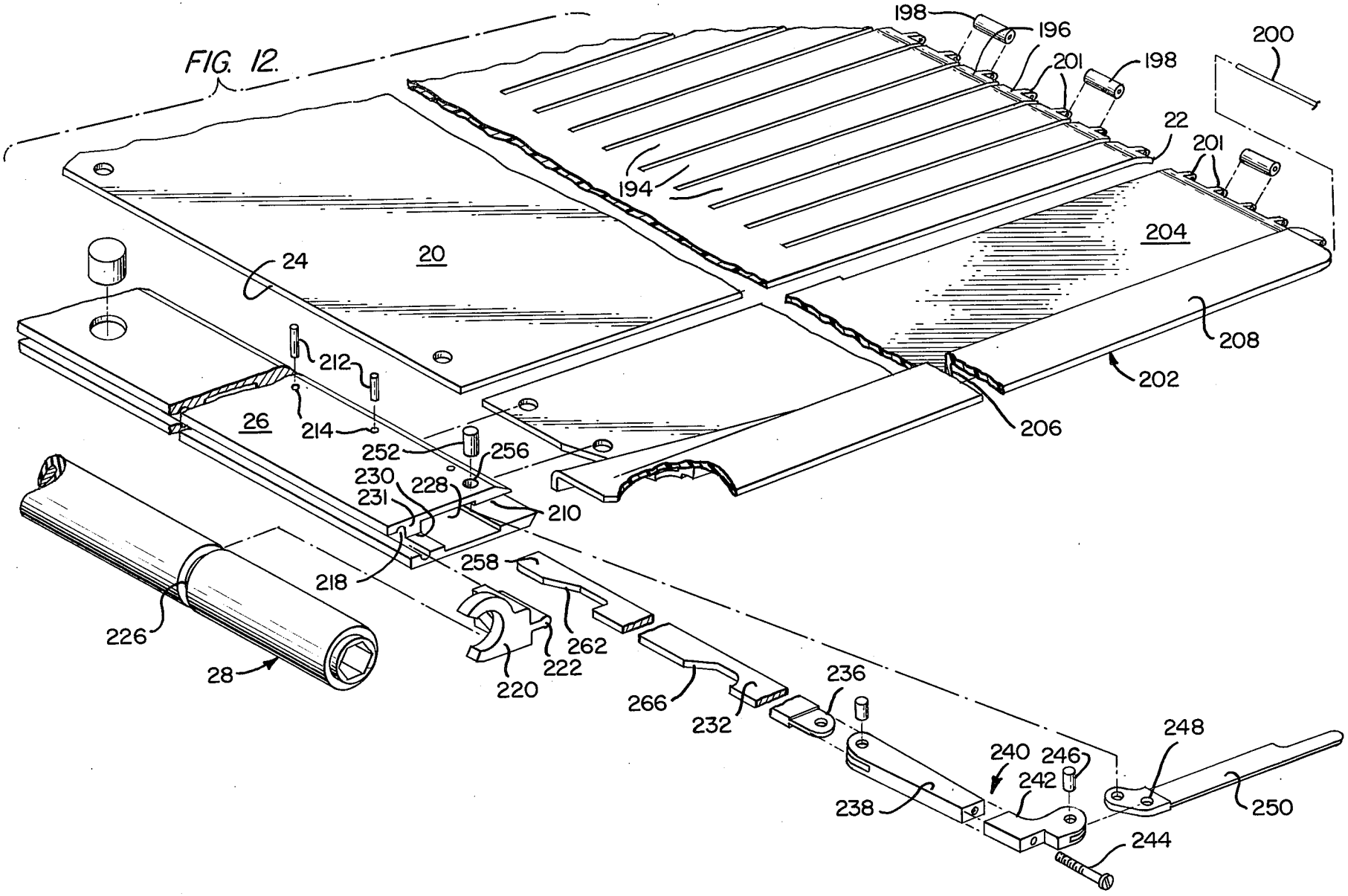
FIG. 12 is an exploded fragmentary perspective view illustrating components of the upper separator assembly for both embodiments of the present invention.
Figure 13:
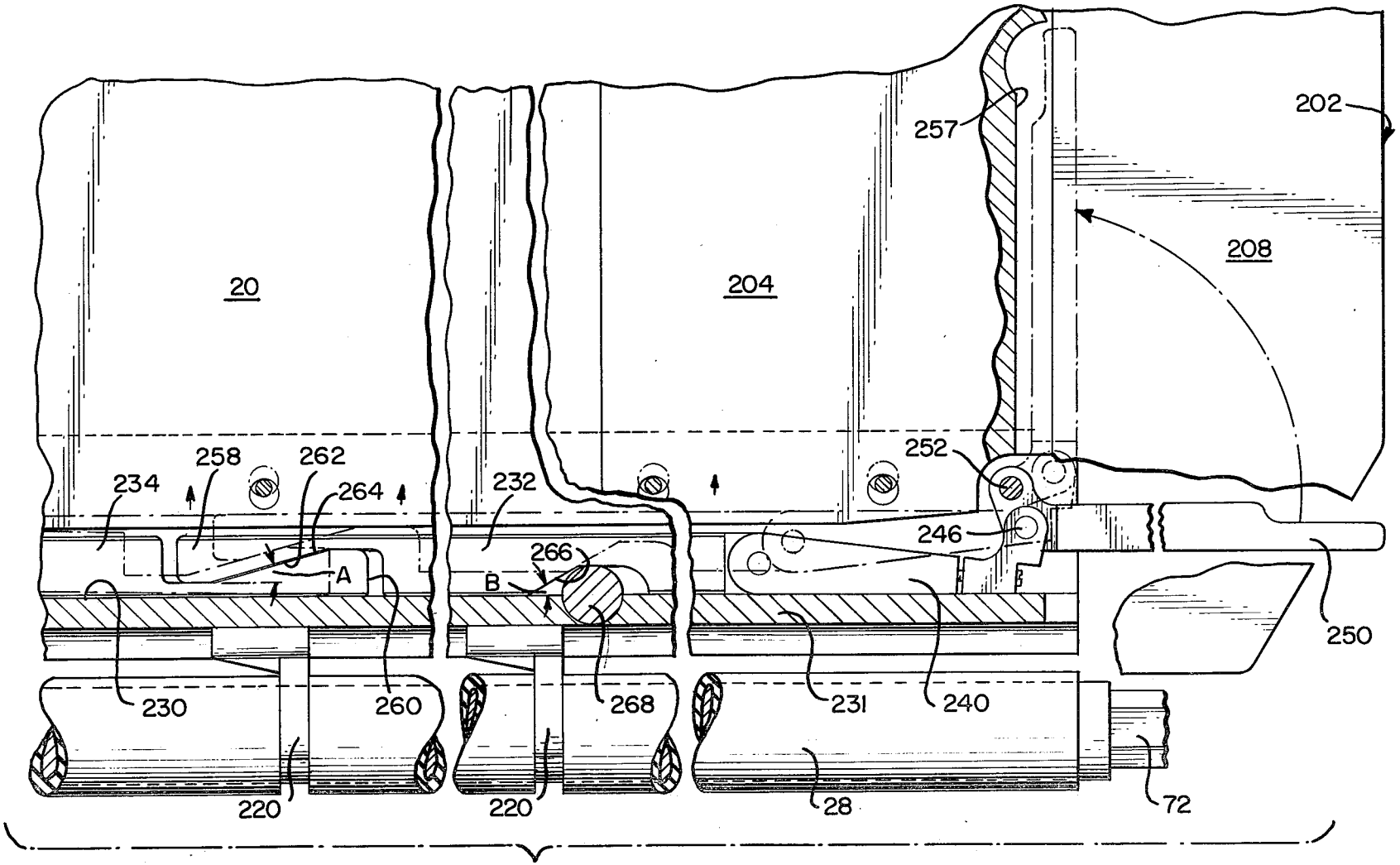
FIG. 13 is a fragmentary plan view in partial cross-section further illustrating components of the upper separator assembly.

In light of the preceding description of separator assembly operation it will be appreciated that transmission of driving torque from the drive roller 28 to the endless belt 30 defining the apron of the upper apron assembly 14 is important to effective patient transfer operation of the mechanism 10 in practice. It is also important that the belt 30 track properly or remain in the same longitudinal position with respect to the separator 20. Reference is made, therefore, to FIGS. 12 and 13 for an understanding of the structural components forming the upper separator assembly 14 and the manner in which such components are interrelated to achieve the intended patient transfer operation.

As shown in FIGS. 12 and 13 of the drawings, the separator plate 20 is a thin flexible plate of suitable material, such as high density polyethylene, for example, preferably on the order of 5 mm. in thickness, 55 cm. in width (the distance between the front and rear edges 22 and 24) and approximately 180 cm. in length. The front portion of the plate 20 is provided with a series of narrow transverse slots 194 extending from the front edge 22 inwardly toward the center of the plate to establish fingers 196 to enhance flexibility over the front portion in which the fingers extend. A plurality of very small guide rollers 198 are journalled for free rotation between the respective fingers 196 along the front edge 22 of the separator plate 20. The rollers are supported on a single longitudinal shaft or wire 200 extending through apertured projections 201 along the front edge 22 throughout the complete length of the separator plate. The wire also supports such rollers along the front edge of a pair of end members 202 which, though initially separate from the plate 20, coact therewith as unit extensions.

Each of the end members 202, as shown, is preferably a molding also of high density polyethylene and shaped to establish a plate portion 204 contiguous with the plate 20 and joined by a vertical wall portion 206 with an elevated wing or cover portion 208. The cover portion 208 overlies the carriage end member 100 so that the relative movement of the separator 20 and the carriage end members does not interfere with the loading surface defined by the upper separator assembly 14. Also, this construction of the upper separator, in conjunction with the single axis connection of the upper separator assembly 14 to the deck assembly by way of the roller drive shafts 74, permits the assembly to pivot upwardly to provide access for such purposes as cleaning, mantenance and adjustment.

The rear edge 24 of the separator plate 20 and correspondingly, of the end members 202, telescope within a forwardly opening slot 210 in the retainer bar 26, which is preferably an extrusion and as such, having a continuous cross-sectional configuration throughout its length. This assembly is slidably secured by a plurality of relatively small diameter pins 212 extending through relatively small apertures 214 in the retainer bar 26 and through relatively large diameter openings 216 near the rear edge 24 of the separator plate 20 and end members 202.

The retainer bar 26 is provided with an undercut track 218 for receiving a series of drive roller clips 220 having mounting lug portions 222 complementing the cross-sectional shape of the track 218 and clip-on journals 224 to engage spaced bearing surfaces 226 of reduced diameter along the length of the drive roller 28. The drive roller extends throughout the length of the separator and is of a diameter on the order of 20 mm. The mounting clips 220, therefore, transmit bending stresses on the drive roller 28 to the retainer bar 26 at increments along its length. Although the exterior surface of the drive roller is provided with a rubber-like traction surface, such support by the retainer bar is needed to maintain the overall thinness of the separator assembly 14 while at the same time enabling the endless belt 30 to be drawn against the roller 28 under sufficient tension to ensure transmission of torque from the roller to the belt.

The slot 210 in the retainer bar opens inwardly to an enlarged track 228 having a rearwardly disposed abutment surface 230 established by a web portion 231 extending along the length of the retainer bar 26. Located in the track 228 are a pair of camming bars 232 and 234 operative in a manner to be described between the abutment surface 230 and the rear edge surface 24 of the separator plate 20.

Each of the camming bars 232 and 234 is pivotally connected at its outer end 236 to one part 238 of an adjustable link 240 having a second L-shaped part 242 secured to the part 238 adjustably by a tension screw 244. The terminal end of the part 242 is connected pivotally by a pin 246 extending through an aperture 248 in a bell crank lever 250. The lever 250 is pivotally mounted with respect to the retainer bar 26 by a pin 252 extending through an aperture 254 in the arm 250 and a pair of opposed apertures 256 near the end of the retainer bar 26 in the flanges defining the track 228 and forwardly opening slot 210. In light of this organization, and as shown most clearly in FIG. 13, movement of the arm 250 between the solid line position to the phantom line position in this figure, will both draw the camming bar 232, 234 and associated link 240 outwardly. Also the pin 246 will be moved through an arc beyond a dead-center position on a line extending parallel to the direction of camming bar movement. The underside of the end member 202 is formed with a recess 257 on the bottom of the plate portion 204 and extending through the vertical wall portion 206 to receive the lever arm 250 in the plane of the separator plate 20. Further, it will be appreciated that by adjusting the tension screw 244, the relative longitudinal position of each camming bar 232, 234 in the track 228 may be established independently of positioning as a result of the aforementioned movement of the arm 250 between the two positions illustrated in FIG. 13.

The inner ends 258 and 260 of the respective camming bars overlap midway along the length of the retainer bar 26 and thus of the separator plate 20 in formations defining mutually engaging camming ramp surfaces 262 and 264. The surfaces 262 and 264 are inclined at an angle A in a manner such that relative outward movement of the bars 232 or 234 will result in an enlargement of the combined widths of the camming bars at their inner ends 258 and 260. A second camming ramp 266 is provided near the outer end of each camming bar and having an inclination represented by the angle B. Each of the second camming ramp surfaces 266 is located adjacent a reaction point established by a pin 268 extending through the retainer bar 26 and centered on the abutment surface 230 in the web portion 231 thereof. The angle B is approximately twice the angle A to provide in the ramp 266 a throw twice the throw for any one of the mutually engaging camming ramp surfaces 262 and 264 for a given longitudinal movement of either of the camming bars 232 or 234.

The camming bars 232 and 234 may be adjusted to serve both belt tensioning and belt tracking functions in the separator assembly 14. In this respect, it is to be noted that the belt 30 is dimensioned to extend around the assembly of the separator plate 20, retainer bar 26 and drive roller 28 in a slightly slackened condition with the arm 250 positioned in solid lines as shown in FIG. 13 so as to present essentially the width of one camming bar 232, 234 between the rear edge 24 of the separator plate 20 and the abutment surface 230 of the retainer bar. If it is assumed that the belt 30 is a perfect cylinder or that the belt 30 will be uniformly tensioned throughout its length upon parallel expansion of the distance between the front edge 22 of the separator plate and the drive roller 28, then the combined length of the link 240 and connected camming rod 232, 234 will be made equal by a proper adjustment of the tension screws 244. The hypothetically perfect belt will be tensioned simply by movement of the arms 250 from the solid line position of FIG. 13 to the phantom line illustrated in this figure so that the both of the camming bars 232 and 234 will be moved outwardly by the same increment of distance. Specifically, the outer ends 236 of each rod will be advanced toward the rear edge 24 of the separator plate as a result of the camming ramps 266 riding on the reaction points provided by the pins 268. In addition, the combined outward movement of the camming rods will cause the mutually engaging camming ramp surfaces 262 and 264 to move the inner end 258 of the camming rod 232 outwardly by the same distance. Thus, the inner edge 24 and correspondingly the outer edge 22 of the separator plate 20 will be advanced out of the retainer bar 26 with all edges remaining parallel to exert a uniform tension on the belt 30 trained about the roller 28 and separator plate 20.

In the event the endless belt 30 is of slightly conical conformation as distinguished from truly cylindrical, a condition to be expected with normal manufacturing tolerances, the belt then will not track properly about the separator assuming the front edge 22 and roller 28 are in true parallel relationship. To correct for such inaccuracies in the belt, either one or the other of the tension screws 244 is adjusted in a manner to reposition one or the other of the camming rods 232 or 234 longitudinally in the track 228. If it is assumed, for example, that the rod 234 remains stationary and the camming rod 232 adjusted toward its outer end as a result of tightening up on the tension screw 244, the outer end of the camming rod 232 again will be moved by a distance as that through which the end 236 of the camming bar 232 is moved. As a result, the separator plate will be canted with respect to the retainer bar 26 to compensate for dimensional irregularities of the belt 30 and the support therefor provided by the roller 28 and separator plate 20. The plate 20 may be canted in the opposite direction by moving the camming rod 234 outwardly by adjusting the length of the link 240 associated with that rod. Accordingly, rods 232 and 234 and associated parts provide effective arrangement by which the belt 30 may be either slackened for removal or adjustment, tensioned to effect complete transmission of driving torque from the roller 28 to the belt or by which the separator assembly may be adjusted to ensure correct tracking of the belt.

Figure 14:
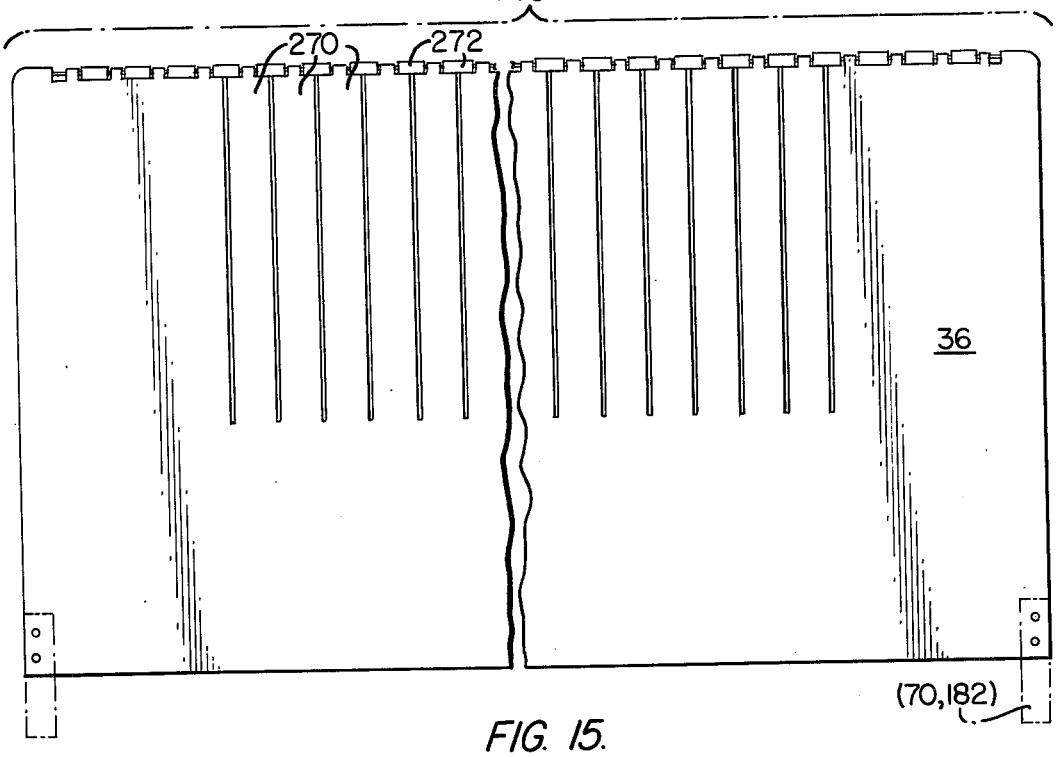
FIG. 14 is a plan view illustrating the lower separator plate construction.

The construction of the lower separator 36 is illustrated in FIG. 14. As shown, the lower separator is essentially a rectangular sheet of thin flexible material such as high density polyethylene on the order of 5 mm. in thickness and dimensioned to be coextensive with the plate end member 20 and plate portions 204 of the upper separator. Like the upper separator, the lower separator is provided with forwardly projecting fingers 270 having apron guide rollers 272 at the projecting ends thereof.

Figure 16:
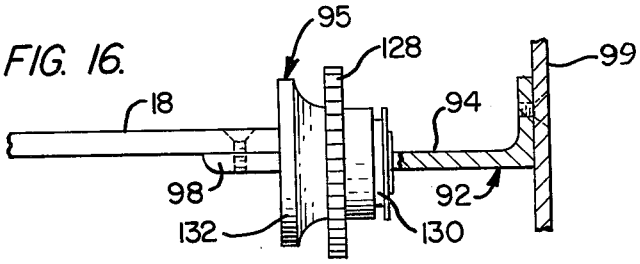
FIG. 16 is an enlarged fragmentary cross-section taken on line 16—16 of FIG. 15.

The previously described carriage assembly including the guide plate 18 end members 95 and carriage end brackets 100 is illustrated most clearly in FIGS. 15 and 16 of the drawings. As shown in FIG. 15, the guide plate 18 is also of a rectangular configuration approximating the size of both the upper and lower separators 18 and 36. The guide plate may be formed of the same material as that from which the separators are formed and is preferably apertured in the interest primarily of weight reduction but also to enhance flexibility of the guide plate 18. Also it will be noted from FIG. 15 that the cleats 98 by which the guide plate is connected with the end members 95 extend only partially from the rear edge to the front edge of the guide plate to leave the front portion of the guide plate relatively unsupported by the end members 95. Thus, any load transmitted to the forward portion of the guide plate through the upper and lower separators 20 and 36 will be transmitted by the front portion of the guide plate directly to the surface over which this portion of the guide plate is extended without transmission of such stresses to the members 95 or carriage end brackets 100. This arrangement also augments a smooth transitiion of patient movement from a relatively soft bed, for example, onto the relatively rigid deck surface of the mechanism.

Thus it will be seen that by this invention there is provided an improved patient transfer mechanism by which the above mentioned objectives are completely fulfilled. Also, it will be apparent to those skilled in the art that modifications and/or changes in the disclosed embodiments may be made without departure from the inventive concept manifested by these embodiments. Accordingly, it is expressly intended that the foregoing description be illustrative of preferred embodiments only, not limiting, and that the true spirit and scope of the present invention be determined by reference to the appended claims.

I claim:

1. In an object transfer mechanism having a load carrying deck with spaced front and rear edges, a translatable support having top and bottom surfaces and a front edge, the support being movable between a retracted position in which the support substantially overlies the deck and an extended position wherein the front edge of the support extends beyond the front edge of the deck, a flexible apron trained about at least the top and front edge surfaces of the support, and means for controlling movement of the apron relative to the support so that the flight portion of the apron trained along the top of the support may be selectively (a) maintained stationary relative to the deck during movement of the support relative to the deck and (b) moved with the support during translating movement thereof relative to the deck, the improvement comprising:

means for translating the support between the retracted position and a maximum extended position in which the front edge of the support is spaced beyond the front edge of the deck by a distance greater than the distance between the front and rear edges of the deck.

2. The apparatus recited in claim 1 wherein said translating means comprises carriage means movable in the direction of support translation relative to the deck, means for translating said carriage means and means for translating the support relative to said carriage means.

3. The apparatus recited in claim 2 wherein said carriage means includes a guide plate underlying the support and the flight portion of the apron trained along the bottom surface of the support.

4. The apparatus recited in claim 3 wherein the support is an upper apron separator and further including a lower separator also having top, bottom and front edge surfaces, said lower separator underlying and connected to said upper separator for translation directly therewith, said guide plate being located between said lower separator and the deck.

5. The apparatus recited in claim 4 including a lower apron trained about at least the top and front edge surfaces of said lower separator, said lower apron being fixed to the deck along the front edge thereof at a level below said lower separator whereby movement of said lower separator beyond the front edge of the deck will form in said lower apron, a lower flight portion held stationary with respect to the deck.

6. The apparatus recited in claim 5 wherein said lower apron comprises a double ended belt trained about the top of said lower separator and having one end fixed to the deck at a level below said lower separator and said guide plate, the other end of said lower apron being extensible from the deck whereby said lower apron is trained over the top of said lower separator about the front edge thereof and under said guide plate when said separator and guide plate are positioned beyond the front edge of the deck.

7. The apparatus recited in claim 1 wherein said translating means comprises carriage means having front and rear edges and including a guide plate underlying the support and overlying the deck in the retracted position of the support, and a single translating drive chain on at least one end of the deck for translating the support through the distance between the retracted position and said maximum extended position while simultaneously translating said guide plate.

8. The apparatus recited in claim 7 comprising rotatable means supporting said endless translating drive chain in a continuous series of flight portions defining a first flight portion supported between the rear edge of the deck and the front edge of said carriage means, a second flight portion supported between the front and rear edges of the carriage means and a third flight portion supported between the rear edge of the carriage and the front edge of the deck, and means connecting the support to said chain in said first flight portion.

9. The apparatus recited in claim 8 comprising means fixing the front portion of said second flight portion against movement relative to the deck whereby chain movement in said first and third flight portions in a forward direction at one unit of velocity will cause a loop in said endless chain between said second and third flight portions to be advanced in the same direction at one-half such unit of velocity.

10. The apparatus recited in claim 8 wherein the support is a plate-like separator having also a rear edge, in which the means for controlling movement of the apron includes a drive roller mounted along the rear edge of the separator and further including an endless drive roller chain for controlling rotation of the drive roller during translating movement of the separator.

11. The apparatus recited in claim 10 including a roller drive sprocket engageable by said roller drive chain, means for transmitting drive torque between said roller drive sprocket and said drive roller, a roller chain drive sprocket journalled in the deck near the front edge thereof for transmitting torque to said roller drive chain, and rotatable means carried by said carriage assembly near the rear edge thereof for supporting a reversing double loop in said roller drive chain, said loop extending from the rear edge portion of said carriage assembly, forwardly over said roller drive sprocket, back to the rear edge portion of said carriage assembly and then forwardly about said chain drive sprocket.

12. The apparatus recited in claim 11 wherein said means for transmitting drive torque between said roller drive sprocket and said drive roller comprises a reversing gear pair.

13. The apparatus recited in claim 11 wherein said means for transmitting drive torque between said roller drive sprocket and said drive roller comprises a drive shaft coaxial with said roller and said roller drive sprocket.

14. The apparatus recited in claim 11 including means to establish a reversible drive source for said translating drive chain, and means including a clutch for releaseably connecting said translating drive chain with said drive roller chain.

15. The apparatus recited in claim 14 wherein said last-mentioned means comprises a clutch drive sprocket directly engaged by said translating chain, said clutch means being operable directly between said clutch drive sprocket and said roller chain drive sprocket.

16. The apparatus recited in claim 14 wherein said last-mentioned means comprises a clutch drive sprocket releaseably connectable with said roller chain drive sprocket by said clutch means and including an endless chain and sprocket transmission for connecting said clutch drive sprocket directly with said translating drive chain.

17. The apparatus recited in claim 7 wherein the support is an upper apron separator having also a rear edge and further including a lower separator underlying and connected to said upper separator for translation directly therewith, said guide plate being located between said lower separator and the deck, a double ended belt trained about the lower separator and having one end fixed to the deck at a level below said lower separator and said guide plate, a rotatable winding cylinder near the rear end of the deck having a winding cylinder drive sprocket coupled with at least one end thereof, the other end of said double ended belt being connected to said winding cylinder, said translating drive chain being engaged with said winding cylinder sprocket to rotate said winding cylinder during translating movement of said separators to pay out or take in said double ended belt.

18. The apparatus recited in claim 17 in which the means for controlling movement of the apron trained about said upper apron separator comprises a drive roller mounted along the rear edge of said upper separator, a roller drive sprocket, means for transmitting drive torque between said roller drive sprocket and said drive roller, an endless drive roller chain engaging said roller drive sprocket for controlling rotation thereof during translating movement of said separators and releaseable coupling means for interconnecting said translating drive chain with said drive roller chain whereby said drive roller and said winding cylinder may be driven by a single torque input to said chains to synchronize movement of said drive roller and said winding cylinder.

19. The apparatus recited in claim 18 including a reversibly rotatable drive source and wherein said drive source and said drive roller are rotated in opposite directions, said means for transmitting torque between said drive roller sprocket and said drive roller comprises a reversing gear pair.

20. The apparatus recited in claim 18 including a reversibly rotatable drive source and wherein said drive source and said drive roller are driven in the same direction of rotation, said means for transmitting torque between said drive roller sprocket and said drive roller comprising a keyed coaxial coupling shaft.

21. A patient transfer mechanism comprising:

a load carrying deck having spaced front and rear edges;

a translatable separator having top and bottom surfaces extending between front and rear edges, said separator being movable between a retracted position wherein the separator is substantially overlying the deck and an extended position wherein the front edge of the separator is spaced beyond the front edge of the deck;

a thin fabric-like apron trained about at least the top and front edge surfaces of said separator;

means for controlling movement of the apron relative to the separator so that the flight portion of said apron trained along the top of said separator may be selectively (a) maintained stationary relative to said deck during movement of the separator relative to said deck and (b) moved with said separator during translating movement thereof relative to said deck;

carriage means movable in the direction of separator translation for moving said separator between said retracted position and a maximum extended position in which the front edge of said separator is spaced beyond the front edge of said deck by a distance greater than the width of said deck; and drive means for translating said carriage means relative to said deck and for translating said separator relative to said carriage means.

22. The apparatus recited in claim 21 wherein said carriage means comprises a guide plate underlying said separator in said retracted position and carriage end brackets connected to said guide plate at opposite ends thereof.

23. The apparatus recited in claim 22 wherein said separator comprises a separator plate having a pair of elevated wing portions at opposite ends thereof to overlie said carriage end brackets.

24. The apparatus recited in claim 21 wherein said separator comprises a separator plate, a retainer bar having a forwardly open slot for slidably receiving the rear edge of said separator plate and an apron drive roller rotatably supported along the rear edge of said retainer bar.

25. The apparatus recited in claim 24 wherein said apron is an endless belt trained about said separator plate, said retainer bar and said drive roller.

26. The apparatus recited in claim 21 wherein said carriage means comprises a guide plate underlying said separator and the flight portion of said apron trained along the bottom surface of said separator.

27. The apparatus recited in claim 26 wherein said separator is an upper apron separator and further including a lower separator also having top and bottom surfaces extending between front and rear edges, said lower separator underlying and connected to said upper separator for translation directly therewith, said guide plate being located between said lower separator and said deck.

28. The apparatus recited in claim 27 including a thin fabric-like lower apron trained about at least the top and front edge surfaces of said lower separator, said lower apron being fixed to the deck along the front edge thereof at a level below said lower separator whereby movement of said lower separator beyond the front edge of the deck will form in said lower apron, a lower flight portion held stationary with respect to said deck.

29. The apparatus recited in claim 28 wherein said lower apron comprises a double ended belt trained about the top of said lower separator and having one end fixed to the deck at a level below said lower separator and said guide plate, the other end of said lower apron being extensible from said deck whereby said lower apron is trained over the top of said lower separator, about the front edge thereof and under said guide plate when said lower separator and guide plate are positioned beyond the front edge of said deck.

30. The apparatus recited in claim 21 wherein said drive means for translating said carriage means and said separator comprises a single reversibly rotatable drive source supported by said deck, a translating drive chain driveably connected to said drive source, and means supporting said translating drive chain in a continuous series of flight portions defining a first flight portion supported between the rear edge of said deck and the front edge of said carriage means, a second flight portion supported between the front and rear edges of said carriage means and a third flight portion supported between the rear edge of the carriage and the front edge of said deck, and means connecting the rear edge of said separator to said translating drive chain in said first flight portion thereof.

31. The apparatus recited in claim 30 including means fixing the front portion of said second flight portion against movement relative to said deck whereby chain movement in said first and third flight portions in a forward direction at one unit of velocity will cause a loop in said endless chain between said second and third flight portions to be advanced in the same direction at one-half such unit of velocity.

32. The apparatus recited in claim 30 in which said means for controlling movement of said apron includes a drive roller mounted along the rear edge of said separator and further including an endless drive roller chain for controlling rotation of the drive roller during translating movement of said separator.

33. The apparatus recited in claim 32 including a roller drive sprocket engageable by said roller drive chain, means for transmitting drive torque between said roller drive sprocket and said drive roller, a roller chain drive sprocket journalled in said deck near the front edge thereof for transmitting torque to said roller drive chain, and rotatable means supported by said carriage near the rear edge thereof for supporting a reversing double loop in said roller drive chain, said loop extending from the rear edge portion of said carriage forwardly over said roller drive sprocket back to the rear edge portion of said carriage assembly and then forwardly about said chain drive sprocket.

34. The apparatus recited in claim 33 comprising releaseable means for connecting or disconnecting said translating chain and said drive roller chain with respect to each other.

35. The apparatus recited in claim 21 wherein said deck comprises a hollow outer shell structure, filled with a rigid foam material.

36. A patient transfer mechanism comprising:

a deck assembly to establish a deck surface having front and rear edges;

a pair of upper and lower translatable separators each having a top and bottom surfaces extending between front and rear edges, said separators being movable together as a unit between a retracted position substantially overlying said deck surface and an extended position located beyond the front edge of said deck surface;

a thin fabric-like apron trained about at least the top, front edge and bottom surfaces of said upper separator;

means for controlling movement of said apron relative to said upper separator so that the flight portion of said apron trained along the top of said upper separator may be selectively (a) maintained stationary relative to said deck assembly during movement of said separators relative to the deck and (b) moved with said upper separator during translating movement thereof relative to said deck;

a guide plate having front and rear edges and underlying said lower separator while in said retracted position; and means for translating said separators between said retracted position and a maximum extended position in which the front edges of said separators are spaced beyond the front edge of said deck surface by a distance greater than the width thereof between said front and rear edges of said deck and for translating said guide plate in the direction of separator translation at a distance wherein the front edge of the guide is spaced beyond the edge of the deck surface by a distance less than the width thereof between the front and rear edges of the deck, whereby said guide plate spans the distance between the rear edge of said lower separator and the front edge of said deck surface when said separators are in said maximum extended position.

37. The apparatus recited in claim 36 wherein said translating means comprises a pair of endless translating drive chains, means supporting one of said translating drive chains in a vertical plane at each end of said deck assembly and including for each of said chains first, second, third and fourth sprockets rotatably supported on their respective axes in said vertical plane to establish a first chain flight between said first and second sprockets, a second chain flight between said second and third sprockets and a third chain flight between said third and fourth sprockets, said chain flights being generally parallel with respect to each other and to said deck surface, the axes of said first and fourth sprockets being fixed with respect to said deck assembly and located near the rear and front edges thereof respectively, the axes of said second and third sprockets being movable with said guide plate and being located near the respective front and rear edges thereof, means connecting said separators near the rear edge thereof to said translating drive chain in said first flight, and means retaining said second chain flight against movement with respect to said deck assembly.

38. The apparatus recited in claim 37 wherein said chain flight retaining means comprises a link extending from the axis of said first sprocket to said second chain flight at a point thereon near said second sprocket when said separators are in said retracted position.

39. The apparatus recited in claim 36 wherein said means for controlling movement of said apron comprises a drive roller rotatably supported along the rear edge of said upper separator, roller drive sprockets at each end of said drive roller, and means for transmitting driving torque between said roller drive sprockets and said drive roller, a pair of endless drive roller chains, means supporting one of said drive roller chains at each end of said deck assembly in a vertical plane containing each of said roller drive sprockets, a roller drive chain drive sprocket on an axis fixed with respect to said deck assembly and located near the front edge thereof and rotatable chain guide means supported on axes movable with said guide plate and located near the rear edge thereof for establishing in said roller drive chain a reversing double loop about said roller drive sprocket whereby the flight configuration of said roller drive chain may vary in the length of said reversing double loop without altering the transmission of torque by said chain to said drive sprocket during movement thereof relative to said guide plate.

40. An apparatus comprising:

a supporting deck structure;

an endless belt;

support means having front and rear ends for defining a parallel flight portion in said endless belt, said support means including at least one drive roller for moving said flight portions relative to said support means, said support means being carried by and translatable with respect to said deck;

carriage means having front and rear ends for translating said support means in the direction of belt flight movement;

a single rotatable drive source; and an endless drive chain and sprocket system for transmitting torque from said rotatable drive source to said drive roller and for translating said support and carriage relative to said deck.

41. The apparatus recited in claim 40 wherein said endless drive chain and sprocket system comprises an endless translating drive chain, means supporting said endless translating drive chain in a continuous series of flight portions defining a first flight portion supported between a rearward point on said deck and the front end of said carriage means, a second flight portion supported between the front and rear ends of said carriage means and a third flight portion supported between the rear end of said carriage and a forwardly disposed point on said deck, means connecting the rear end of said support means to said translating drive chain in said first flight portion, means fixing the front portion of said second flight portion of said translating drive chain against movement relative to said deck whereby chain movement in said first and third flight portions in a forward direction at one unit of velocity will cause a loop in said endless chain between said second and third flight portions to be advanced in the same direction and at one-half such unit of velocity, an endless roller drive chain, means driveably connecting said roller drive chain with said translating drive chain, and rotatable means carried by said carriage means near the rear end thereof for supporting a reversing double loop in said roller drive chain whereby movement of said support means relative to said carriage means is independent of torque transmission from said roller drive chain to said drive roller.

* * * * *